US007873292B2

(12) United States Patent
Kim et al.

(10) Patent No.: US 7,873,292 B2
(45) Date of Patent: Jan. 18, 2011

(54) IMAGE FORMING APPARATUS AND TRANSFER METHOD THEREOF

(75) Inventors: Jeong-hwan Kim, Gunsan-si (KR); Se-ra Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 421 days.

(21) Appl. No.: 11/954,645

(22) Filed: Dec. 12, 2007

(65) Prior Publication Data

US 2008/0159764 A1 Jul. 3, 2008

(30) Foreign Application Priority Data

Jan. 2, 2007 (KR) ..... 10-2007-0000275

(51) Int. Cl.
*G03G 15/16* (2006.01)

(52) U.S. Cl. ..... 399/66

(58) Field of Classification Search ..... 399/66
See application file for complete search history.

(56) References Cited

U.S. PATENT DOCUMENTS

| | | | | |
|---|---|---|---|---|
| 5,187,536 | A | 2/1993 | Hasegawa et al. | |
| 5,469,248 | A | 11/1995 | Fujiwara et al. | |
| 6,021,287 | A | 2/2000 | Tanaka | |
| 6,029,022 | A * | 2/2000 | Takase | 399/66 |
| 6,134,415 | A | 10/2000 | Iwakura et al. | |
| 6,766,123 | B2 * | 7/2004 | Ebihara et al. | 399/66 |

FOREIGN PATENT DOCUMENTS

| | | |
|---|---|---|
| JP | 10-228186 | 8/1998 |
| JP | 2003-316109 | 11/2003 |
| KR | 1999-38550 | 6/1999 |
| KR | 2005-66983 | 6/2005 |

OTHER PUBLICATIONS

European Search Report dated May 8, 2008.
European Search Report dated Aug. 8, 2008 issued in EP 07123838.0.
Thomson Scientific, London, GB; AN—"Database WPI Week 199844"—XP002489598—1998-516385.

* cited by examiner

*Primary Examiner*—David M Gray
*Assistant Examiner*—G. M. Hyder
(74) *Attorney, Agent, or Firm*—Stanzione & Kim, LLP

(57) ABSTRACT

An image forming apparatus includes a moving unit which includes a conveyer belt to move a recording medium, an attraction unit which is disposed at a front head in a moving direction of the recording medium and attracts the recording medium to the conveyer belt, a plurality of transferring units including a photosensitive material and a transfer roller to perform a transferring process of the recording medium according to a plurality of colors, a power supply to supply power to form an electric field in the transferring unit and the attraction unit to perform transfer and attraction of the recording medium, and a controller to control the power supply to supply the power to the plurality of transferring units corresponding to resistance values of second transferring units among the plurality of transferring units, the second transferring units disposed apart from a first transferring unit that is located closest to the attraction unit with respect to the moving direction of the recording medium.

9 Claims, 9 Drawing Sheets

IMAGE FORMING APPARATUS AND TRANSFER METHOD THEREOF

CROSS-REFERENCE TO RELATED APPLICATIONS

This application claims priority under 35 U.S.C. §119(a) from Korean Patent Application No. 10-2007-0000275, filed on Jan. 2, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus. More particularly, the present general inventive concept relates to an image forming apparatus that determines a transfer voltage or a transfer current.

2. Description of the Related Art

A conventional image forming apparatus forms an image for outputting contents generated by a computer program on a recording medium. Particularly, the conventional image forming apparatus forms an electrostatic latent image by scanning light to a photosensitive medium, develops the electrostatic latent image with a developer, and transfers and fixes the developed electrostatic latent image on a paper so as to form an image.

FIG. 1 illustrates a transfer process of a conventional image forming apparatus. As illustrated in FIG. 1, the conventional image forming apparatus sets a transferring unit 2*a* disposed closest to an attraction unit 1, which uses an attraction roller 1*a*, as a reference transferring unit among a plurality of transferring units 2, and obtains a resistance value of the transferring unit 2*a* by detecting a current flowing to the transferring unit 2*a* so as to determine an optimal transfer voltage and/or current in a pre-printing process which is performed before printing on a recording medium. Herein, a resistance value of the transferring unit 2*a* is obtained by using a photosensitive material, a conveyer belt that passes the corresponding transferring unit 2*a*, and a transfer roller that is disposed facing the photosensitive material with respect to the conveyer belt and transfers a toner that has been developed to a charged photosensitive material to the recording medium.

Therefore, when the resistance value of the transferring unit 2*a* is obtained, the conventional image forming apparatus detects a current flowing to the attraction unit 1 and obtains a resistance value thereof. In this case, the resistance value of the attraction unit 1 is determined by the attraction roller (ATTR) 1*a* that attracts the recording medium to the conveyor belt and a driving roller that moves the recording medium to be transferred to the transferring unit 2 by the conveyer belt.

When the recording medium enters into the attraction unit 1, the conventional image forming apparatus obtains the resistance value of the attraction unit 1 by detecting the current flowing thereto so as to obtain a resistance value corresponding to the recording medium.

An optimal transfer voltage for a transferring operation can be determined by the resistance value obtained in such a manner.

However, the conventional image forming apparatus obtains the resistance value of the transferring unit 2*a* located closest to the attraction unit 1. Therefore, when power is applied to the attraction unit 1 for obtaining the resistance value of the attraction unit 1, a leakage current from the attraction unit 1 interacts between the transferring unit 2*a* and the attraction unit 1, and it is difficult to obtain the accurate resistance value of the transferring unit 2*a*.

FIG. 2 illustrates a transferring process of the conventional image forming apparatus for a recording medium with respect to time.

As illustrated in FIG. 2, the conventional image forming apparatus obtains the resistance value of the transferring unit 2*a* during time t1 to time t2, and then obtains the resistance value of the attraction unit 1 during time t2 to time t3 after perception of the resistance value of the transferring unit 2*a* is completed.

Then, at a time after passing time t4 to time t5 but before the recording medium enters into the attraction unit 1, the conventional image forming apparatus obtains a resistance value of the recording medium entering the attraction unit 1 during time t5 to time t6. Through the obtained resistance value, the transfer process is performed on the recording medium after time t6.

In this case, since the leakage current from the attraction unit 1 interacts between the attraction unit 1 and the transferring unit 2*a*, the resistance value of the transferring unit 2*a* and the resistance value of the attraction unit 1 cannot be simultaneously obtained, but has to be separately obtained during time t1 to time t2 and time t2 to time t4, thereby increasing a pre-printing time for printing the recording medium.

The above information disclosed in this Background section is only for enhancement of understanding of the background of the present general inventive concept, and therefore it may contain information that does not form the prior art that is already known in this country to a person of ordinary skill in the art.

SUMMARY OF THE INVENTION

The present general inventive concept provides an image forming apparatus and a transferring method thereof to determine an accurate transfer voltage and/or current while minimizing time corresponding to a pre-printing process by obtaining a resistance value of a transferring unit without an effect of a leakage current of an attraction unit in the pre-printing process.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus comprising a moving unit comprising a conveyer belt to move a recording medium, an attraction unit which is disposed at a front head in a moving direction of the recording medium to attract the recording medium to the conveyer belt, a plurality of transferring units comprising a photosensitive material and a transfer roller and to perform a transferring process of the recording medium according to a plurality of colors, a power supply to supply power to form an electric field in the transferring unit and the attraction unit to perform transfer and attraction operations of the recording medium, and a controller to control the power supply to supply the power to the plurality of transferring units corresponding to resistance values of second transferring units among the plurality of transferring units, the second transferring units disposed apart from a first transferring unit that is located closest to the attraction unit with respect to the moving direction of the recording medium.

The controller may comprise a voltage and/or current detector to detect an amount of a voltage and/or current flowing in the second transferring units and the attraction unit according to the power supplied from the power supply, and a transfer voltage and/or current determiner to obtain the resistance values of the second transferring units by the detected current to determine a transfer voltage.

The voltage and/or current detector may detect respective voltage and/or current values when the recording medium is attracted to the conveyer belt and when the recording medium is not attracted to the conveyer belt, and the controller may obtain a resistance value that corresponds to the recording medium through the detected respective voltage and/or current values.

The controller may control respective times of obtaining the resistance values of the second transferring units and of obtaining the resistance value of the attraction unit to be overlapped with each other when the recording medium is not attracted to the conveyer belt.

The controller may obtain the resistance values of the second transferring units and the resistance value of the attraction unit when the recording medium is not attracted to the conveyer belt within a certain period of time.

The controller may control to supply the power corresponding to the resistance value of one of the second transferring units that is located furthest in the moving direction of the recording medium with reference to the plurality of transferring units.

The foregoing and/or other aspects and utilities of the present general inventive concept may also be achieved by providing a transferring method of an image forming apparatus comprising a moving unit which comprises a conveyer belt to move a recording medium, an attraction unit which is located at a head portion in a moving direction of the recording medium and attracts the recording medium to the conveyer belt, and a plurality of transferring units which comprise a photosensitive material and a transfer roller and perform a transferring process of the recording medium according to a plurality of colors, the transferring method comprising: detecting a voltage and/or current flowing in second transferring units among the plurality of transferring units and the attraction unit, the second transferring units located apart from a first transferring unit that is located closest to the attraction unit with respect to the moving direction of the recording medium, obtaining resistance values of the second transferring units and a resistance value of the attraction unit according to the detected voltage and/or current, determining power of the transferring process of the recording medium according to the obtained resistance values of the second transferring units, and supplying the determined power to the plurality of transferring units.

The detecting of the voltage and/or current may comprise detecting respective voltage and/or current values when the recording medium is attracted to the conveyer belt by the attraction unit and when the recording medium is not attracted to the conveyer belt, and the obtaining of the resistance values of the second transferring units and the attraction unit comprises obtaining a resistance value that corresponds to the recording medium through the detected respective voltage or current values.

The obtaining of the resistance values of the second transferring units and the attraction unit may comprise overlapping a time of obtaining the resistance values of the second transferring units and a time of obtaining the resistance value of the attraction unit when the recording medium is not attracted to the conveyer belt within a certain period of time.

The obtaining of the resistance values of the second transferring units and the attraction unit may comprise obtaining the resistance values of the second transferring units and the resistance value of the attraction unit when the recording medium is not attracted to the conveyer belt.

The detecting of the voltage and/or current may comprise detecting the voltage and/or current of one of the second transferring units located furthest in the moving direction of the recording medium with reference to the plurality of transferring units.

The foregoing and/or other aspects and utilities of the present general inventive concept may also be achieved by providing an image forming apparatus, comprising an attraction unit to attract a recording medium to a conveyer belt in the image forming apparatus, a plurality of transferring units to perform a transferring process of the recording medium, and a controller to supply power to perform the transferring process by detecting a leakage voltage and/or leakage current produced by the plurality of transferring units and obtaining a resistance value of the attraction unit and any one of the plurality of transferring units with a smallest leakage voltage and/or leakage current value.

The transferring process of the recording medium may be performed by each of the plurality of transferring units corresponding to a plurality of ink colors.

The controller may obtain a resistance value of the transferring unit furthest from the attraction unit.

The controller may simultaneously obtain the resistance value of the one of the plurality of transferring units with the smallest leakage voltage and/or leakage current value and the resistance value of the attraction unit.

The controller may determine a magnitude of power generated by the transferring process corresponding to the recording medium according to the obtained resistance values of the attraction unit and the one of the plurality of transferring units with the smallest leakage voltage and/or leakage current value.

The controller may supply the power at the determined magnitude to the plurality of transferring units.

The foregoing and/or other aspects and utilities of the present general inventive concept may also be achieved by providing a transferring method of an image forming apparatus, comprising attracting a recording medium to a conveyer belt in the image forming apparatus by an attraction unit, detecting a leakage voltage and/or leakage current produced by a plurality of transferring units that transfer the recording medium, obtaining a resistance value of the attraction unit, obtaining a resistance value of any one of the plurality of transferring units with a smallest leakage voltage and/or leakage current value, and supplying power to the plurality of transferring units to perform a transferring process of the recording medium based on the obtained resistance value of the attraction unit and the one of the plurality of transferring units with the smallest leakage voltage and/or leakage current value.

The method may further comprise obtaining a resistance value of the transferring unit furthest from the attraction unit.

The method may further comprise determining a magnitude of the power generated by the transferring process corresponding to the recording medium according to the obtained resistance values, and supplying the power at the determined magnitude to the plurality of transferring units.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
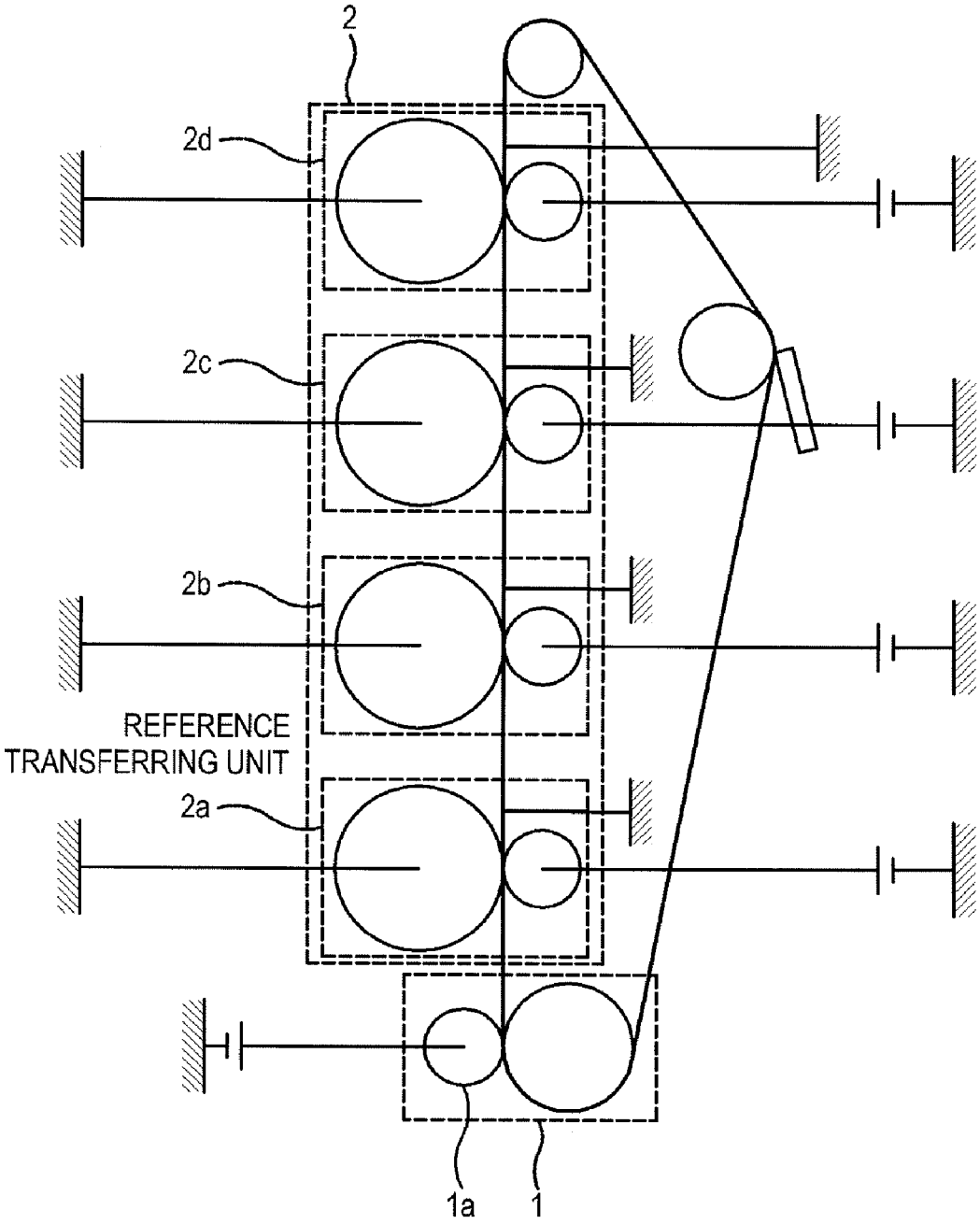
FIG. 1 (RELATED ART)
FIG. 1 is a cross-section view of a transferring process of a conventional image forming apparatus.
Figure 2:
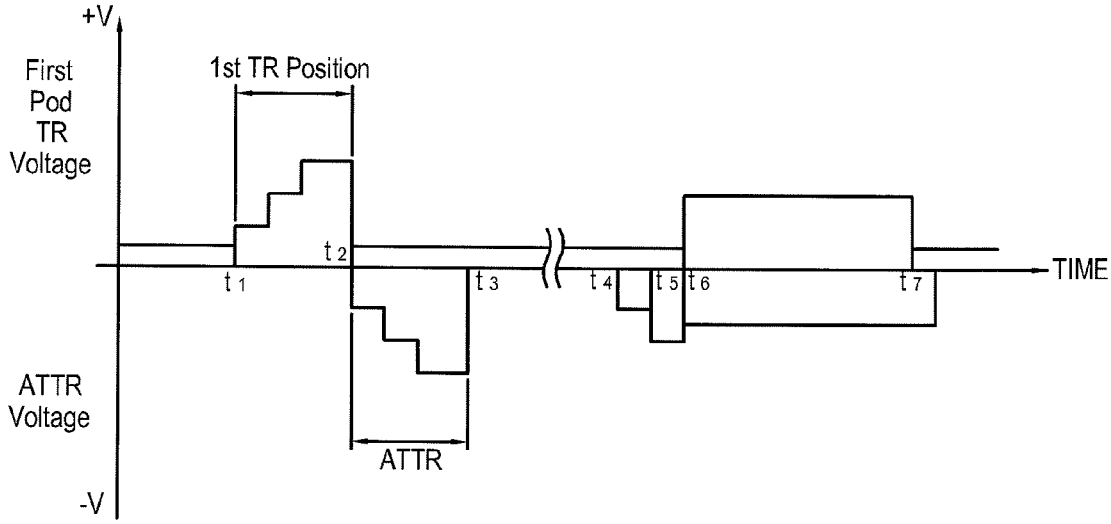
FIG. 2 (RELATED ART)
FIG. 2 illustrates a system obtaining process of the conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Hereinafter, an image forming apparatus 1 according to an exemplary embodiment of the present general inventive concept will now be described in further detail with reference to the accompanying drawings.

Figure 3:
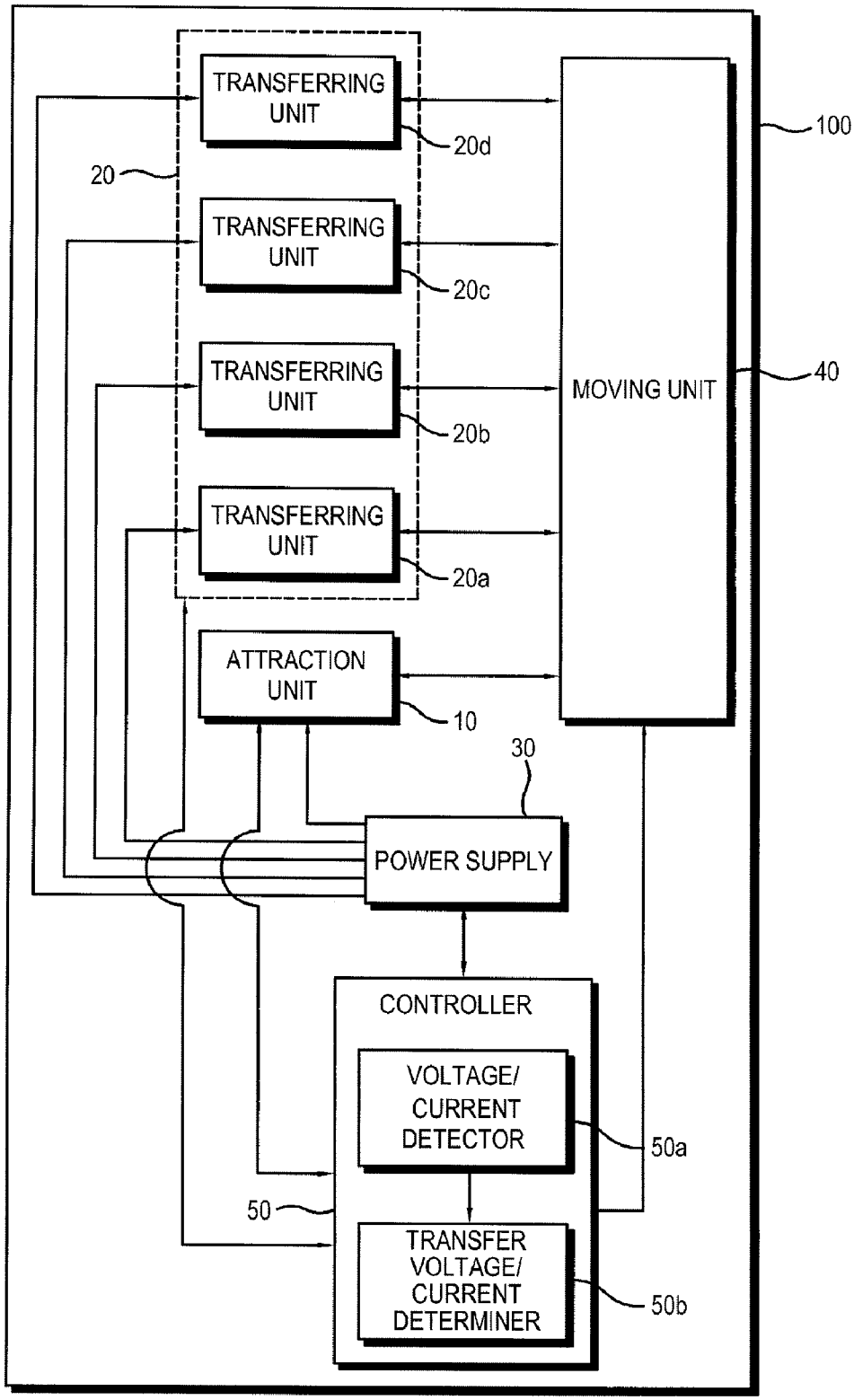
FIG. 3 is a block diagram of an image forming apparatus according to an exemplary embodiment of the present general inventive concept.
Figure 4:
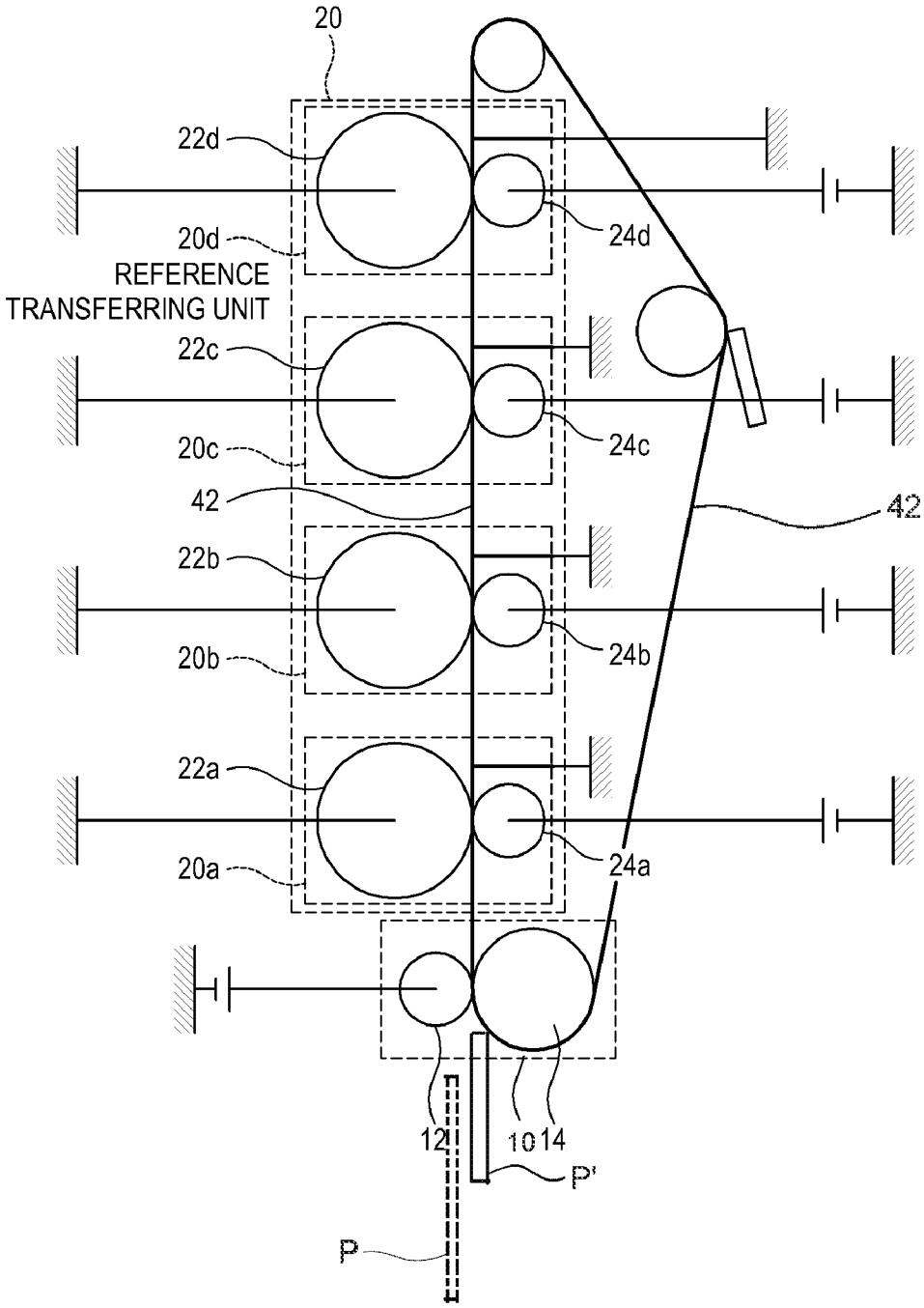
FIG. 4 illustrates a transferring process of the image forming apparatus according to an exemplary embodiment of the present general inventive concept.

FIG. 3 is a block diagram of an image forming apparatus 100 according to an exemplary embodiment of the present general inventive concept, and FIG. 4 illustrates a transfer process of the image forming apparatus 100 according to the exemplary embodiment of the present general inventive concept.

As illustrated in FIG. 3, the image forming apparatus 100 includes an attraction unit 10, a transferring unit 20, a power supply 30, a moving unit 40, and a controller 50, and may be provided as a printing apparatus having transferring units respectively corresponding to colors including CMYK (i.e., cyan, magenta, yellow, and black, respectively).

The attraction unit 10 includes an attraction roller 12 and a driving roller 14, and attracts a recording medium P to a conveyer belt 42 through which the recording medium is moved to the transferring unit 20. As illustrated in FIG. 4, the recording medium P is not attracted to the attraction unit 10 and the recording medium P' is attracted to the attraction unit 10.

The transferring unit 20 includes a plurality of photoconductors 22*a*, 22*b*, 22*c*, and 22*d*, and a plurality of transfer rollers 24*a*, 24*b*, 24*c*, and 24*d* that transfer ink onto a recording medium according to a plurality of colors. The transferring unit 20 is connected with the attraction unit 10 by the conveyer belt 42. The plurality of transfer rollers 24*a*, 24*b*, 24*c*, and 24*d* are disposed opposite to the plurality of photoconductors 22*a*, 22*b*, 22*c*, and 22*d*, respectively. The conveyer belt 42 separates the plurality of transfer rollers 24*a*, 24*b*, 24*c*, and 24*d* from the plurality of photoconductors 22*a*, 22*b*, 22*c*, and 22*d*, respectively, and transfers a toner developed on each of the plurality of photoconductors 22*a*, 22*b*, 22*c*, and 22*d* to the recording medium. Herein, the transferring unit 20 includes a first transferring unit 20*a* and second transferring units 20*b*, 20*c*, and 20*d*. The first transferring unit 20*a* is disposed closest to the attraction unit 10 with regard to the second transferring units 20*b*, 20*c*, and 20*d*, which are disposed apart from the first transferring unit 20*a* with respect to a moving direction of the recording medium. A number of transferring units 20 may be provided so as to respectively correspond to the CMYK according to an exemplary embodiment of the present general inventive concept.

The power supply 30 supplies an attraction power and a transfer power to the attraction unit 10 and the transferring unit 20, respectively, so as to form an electric field to help perform the attraction and transfer of the recording medium.

The moving unit 40 includes the conveyer belt 42, and moves the recording medium to the transferring unit 20 from the attraction unit 10.

The controller 50 controls the power supply 30 to supply power that corresponds to resistance values of the second transferring units 20*b*, 20*c*, and 20*d*, to the first transferring unit 20*a* and the second transferring units 20*b*, 20*c*, and 20*d*.

Additionally, the controller 50 obtains one resistance value among the second transferring units 20*b*, 20*c*, and 20*d*, and the transfer power may be supplied corresponding to the obtained resistance value. More specifically, the controller 50 may obtain a resistance value of the transferring unit 20*d*, which is disposed furthest from the attraction unit 10 and therefore contacts the recording medium last during a printing operation.

The controller 50 according to an exemplary embodiment of the present general inventive concept may include a voltage and/or current detector 50*a* and a transfer voltage and/or current determiner 50*b*. The voltage and/or current detector 50*a* detects the size of a voltage and/or current flowing to the transferring unit 20, and the transfer voltage and/or current determiner 50*b* obtains the resistance value of the second transferring units 20*b*, 20*c*, and 20*d* according to the detected voltage and/or current and determines a transfer voltage or a transfer current.

The voltage and/or current detector 50*a* is formed of a circuit to feed back the voltage and/or current flowing in the transferring unit 20 to the power supply 30, and the transfer voltage and/or current determiner 50*b* is provided as software that determines an amount of the transfer voltage and/or current based on the resistance value obtained through the detected voltage and/or current.

Figure 5A:
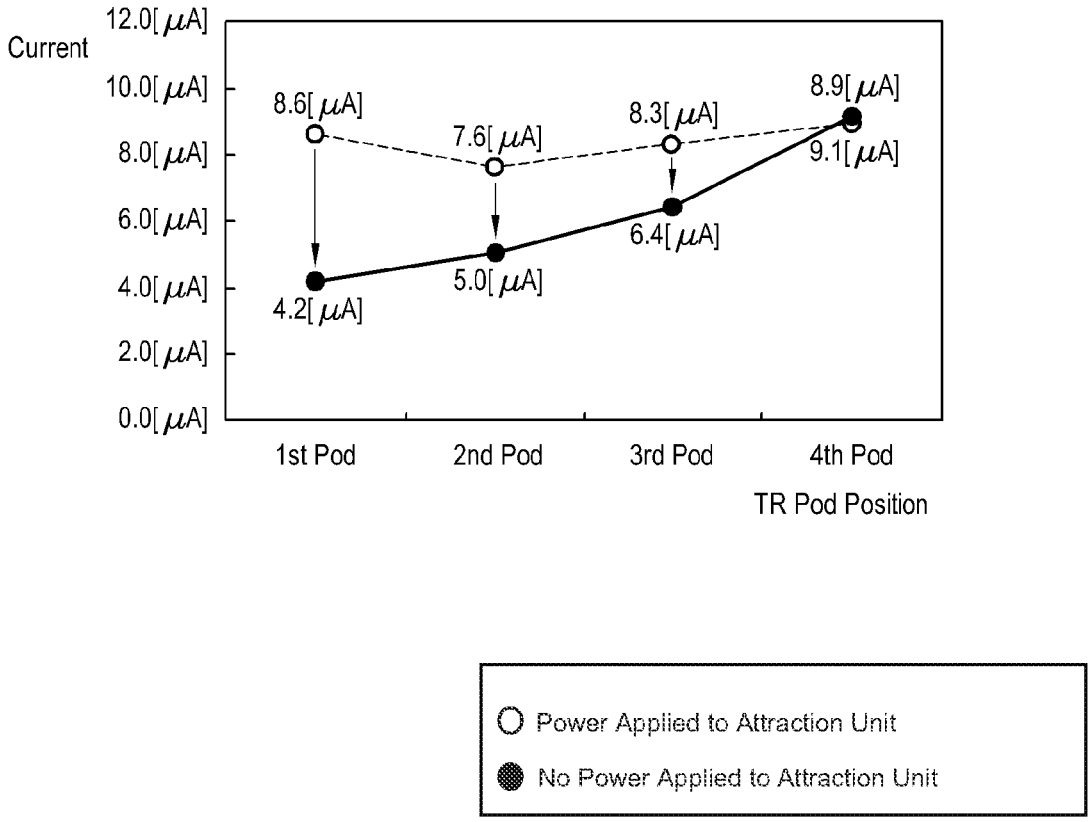
FIG. 5A to FIG. 5C illustrate interaction in the image forming apparatus according to an exemplary embodiment of the present general inventive concept.

FIG. 5A illustrates an amount of current flowing in each of the transferring units 20*a*, 20*b*, 20*c*, and 20*d*, when power is applied or not applied to the attraction unit 10. As illustrated in FIG. 5A, when the power is applied to the attraction unit 10, the first transferring unit 20*a* disposed closest to the attraction unit 10 has a leakage current value of 4.4 μA (=8.6 μA−4.2 μA), which is a largest value, and the second transferring unit 20*d*, which is disposed farthest from the attraction unit 10, has a leakage current value of 0.2 μA (=9.1 μA−8.9 μA) which is a smallest value.

Figure 5B:
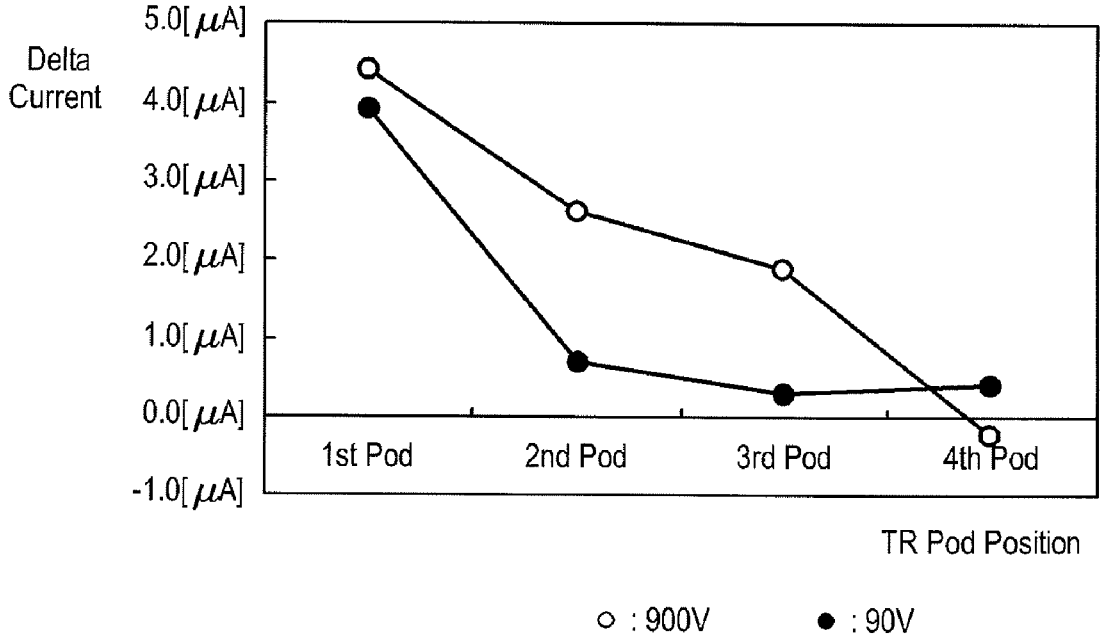

FIG. 5B illustrates an amount of current flowing in each of the transferring units 20*a*, 20*b*, 20*c*, and 20*d* according to an amount of voltage applied to the transferring units 20*a*, 20*b*, 20*c*, and 20*d* when power is applied to the attraction unit 10 and the transferring units 20*a*, 20*b*, 20*c*, and 20*d*.

As illustrated in FIG. 5B, the amount of the current increases as the amount of the voltage applied to the transferring unit 20 increases, and the first transferring unit 20*a*, which is disposed closest to the attraction unit 10 at a first pod position (i.e., 1$^{st}$ Pod), has leakage current values (i.e., delta current values) of 3.9μA and 4.4μA -corresponding to applied powers of 90V and 900V, respectively, and the second transferring unit 20*d*, which is disposed farthest from the attraction unit 10 at a fourth pod position (i.e., $4^{th}$ Pod), has leakage current values of 0.4μA and -0.2μA corresponding to applied powers of 90V and 900V, respectively. The TR Pod Position illustrated in FIG. 5B refers to a location of the transferring units 20 with respect to the attraction unit 10. That is, the first transferring unit 20*a* is disposed at the first pod position which is closest to the attraction unit 10. The second, third, and fourth transferring units 20*b*, 20*c*, and 20*d* are respectively disposed at the second, third, and fourth pod positions which are located further away from the attraction unit 10 than the first transferring unit 20*a*.

That is, the transferring unit 20*a*, which is disposed closest to the attraction unit 10, has the largest leakage current value, and the transferring unit 20*d*, which is disposed farthest from the attraction unit 10, has the smallest leakage current value.

Figure 5C:
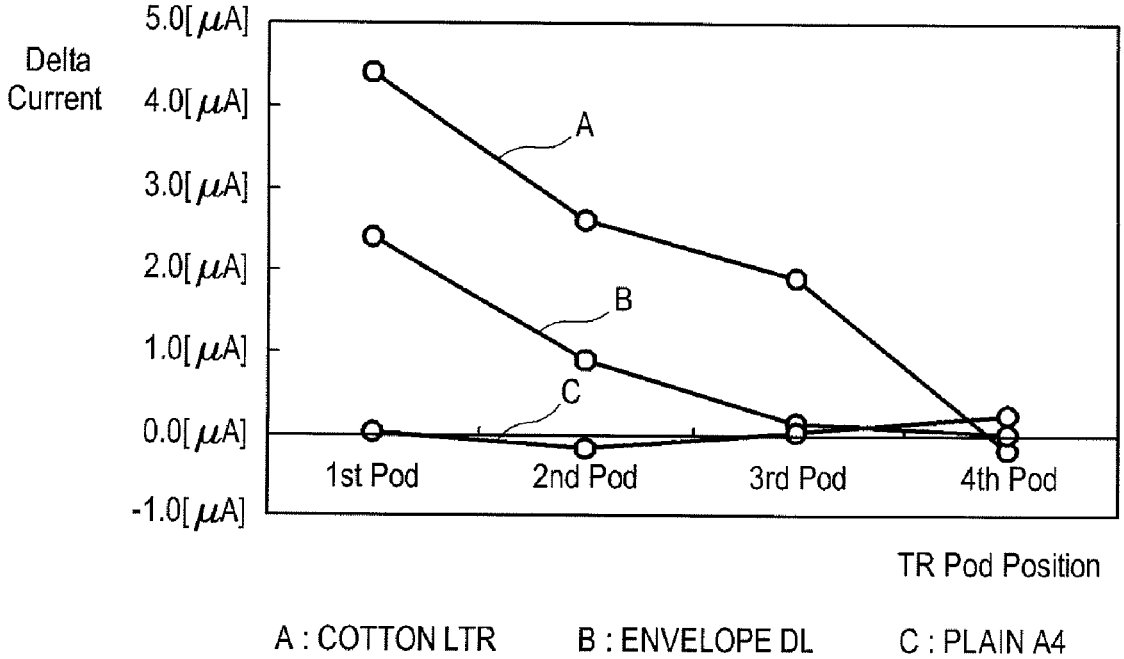

FIG. 5C illustrates an amount of current flowing in each of the transferring units 20*a*, 20*b*, 20*c*, and 20*d* according to a type of recording medium when power is applied to the attraction unit 10 and the transferring units 20. As illustrated in FIG. 5C, the second transferring unit 20*d*, which is disposed farthest from the attraction unit 10, has the smallest leakage current value corresponding to the power applied to the attraction unit 10, regardless of the type of the recording medium used.

As described above, when the resistance value is obtained by setting the second transferring unit 20*d*, which is disposed farthest from the attraction unit 10, as a reference transferring unit in the pre-printing process of obtaining the resistance values of the first transferring unit 20*a* and the second transferring units 20*b*, 20*c*, and 20*d*, the leakage current value becomes less than 1.0 μA, which is a smaller value than values corresponding to any of the other second transferring units 20*b* and 20*c* due to a minimized interaction between the second transferring unit 20*d* and the attraction unit 10.

Figure 6:
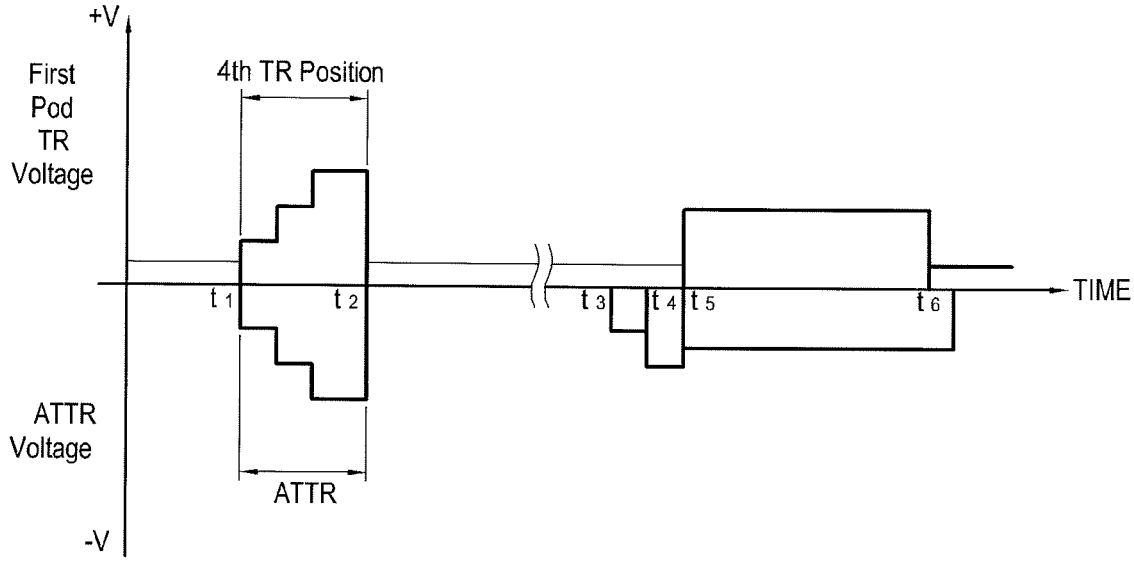
FIG. 6 illustrates a system obtaining process of the image forming apparatus according to an exemplary embodiment of the present general inventive concept.

FIG. 6 illustrates a transferring process of the image forming apparatus 100 corresponding to the recording medium with respect to time according to an exemplary embodiment of the present general inventive concept.

As illustrated in FIG. 6, since the image forming apparatus 100 can minimize an interaction between the attraction unit 10 and the transferring unit 20, the image forming apparatus 100 can obtain a resistance value of the attraction unit 10 while obtaining a resistance value of the first transferring unit 20*a* during time t1 to time t2. That is, the controller 50 can control time of obtaining the resistance values of the respective second transferring units 20*b*, 20*c*, and 20*d* to overlap the time of obtaining the attraction unit 10, and can simultaneously obtain the resistance values of the second transferring units 20*b*, 20*c*, and 20*d* and the resistance value of the attraction unit 10.

At a time after passing time t3 to time t4 but before the recording medium enters the attraction unit 10, the controller 50 obtains the resistance value of the recording medium that enters the attraction unit 10 during time t4 to time t5. With the above-obtained resistance values, a transferring process is performed on the recording medium after time t5.

Therefore, since the image forming apparatus 100 according to an exemplary embodiment of the present general inventive concept can obtain the resistance value of the transferring unit 20 and the resistance value of the attraction unit 10 according to the transfer power and the attraction power applied from the power supply 30 during time t1 to time t2, a time corresponding to a pre-printing process can be reduced.

If the leakage voltage or leakage current from the transferring unit 20 attraction is less than a predetermined value that does not affect the interaction between the attraction unit 10 and the transferring unit 20, any other second transferring unit 20*b* or 20*c* may be set as the reference transferring unit to obtain the resistance value. That is, the controller 50 can obtain the resistance value by setting any one of the transferring units 20*b*, 20*c*, and 20*d* which are disposed apart from the first transferring unit 20*a* with respect to the moving direction of the recording medium, as the reference transferring unit.

A transferring method of the image forming apparatus 100 according to an exemplary embodiment of the present general inventive concept will be described in further detail with reference to FIG. 7.

Figure 7:
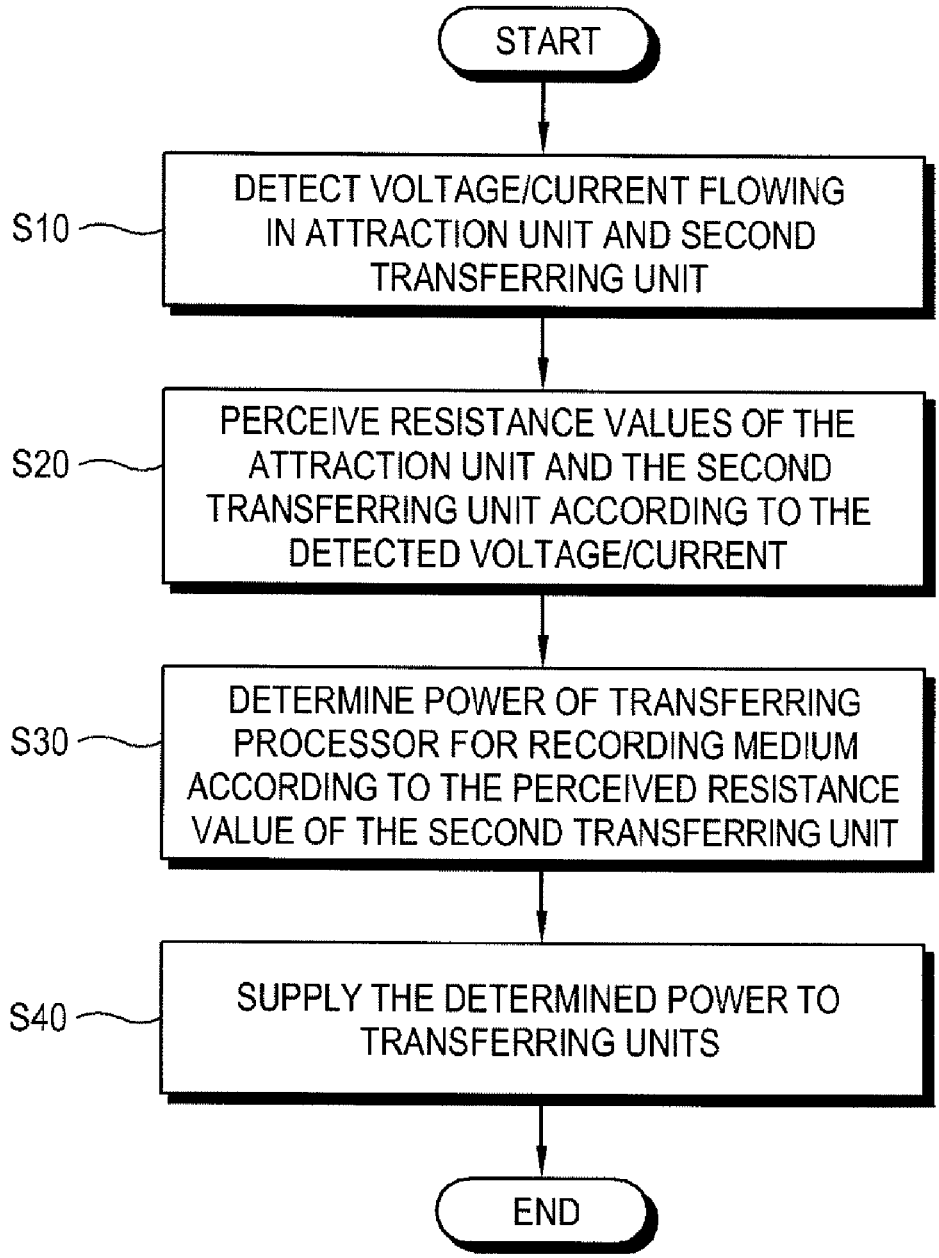
FIG. 7 is a flowchart of a transferring method of the image forming apparatus according to an exemplary embodiment of the present general inventive concept.

Referring to FIGS. 3-4 and 7, in operation S10, the controller 50 detects a voltage or a current flowing to the attraction unit 10 and the second transferring units 20*b*, 20*c*, and 20*d*. The controller 50 may detect the voltage or the current flowing in at least one of the second transferring units 20*b*, 20*c*, and 20*d*. Furthermore, the transferring unit 20*d* may be ideally utilized since it is disposed furthest from the attraction unit 10 and therefore contacts the recording medium last during a printing operation.

In operation S20, the controller 50 obtains the resistance values of the attraction unit 10 and the second transferring units 20*b*, 20*c*, and 20*d* according to the voltage or current obtained in operation S10. In operation S30, the controller 50 determines the power of the transferring process corresponding to the recording medium according to the resistance values obtained in operation S20.

In operation S40, the controller 50 controls the power supply 30 to supply the power determined in operation S30 to the plurality of transferring units 20*a*, 20*b*, 20*c*, and 20*d*.

An embodiment of the present general inventive concept described in detail above is not restricted to the above description, and various modifications can be made within the scope of the appended claims.

As described above, an image forming apparatus and a transferring method of accurately determining a power of a transferring process of a recording medium regardless of an interaction between an attraction unit and a transferring unit can be provided.

In addition, an image forming apparatus and a transferring method of reducing a time in a pre-printing process of obtaining resistance values of an attraction unit and a transferring unit can be provided.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

an attraction unit to attract a recording medium to a conveyer belt in the image forming apparatus;

a plurality of transferring units to perform a transferring process of the recording medium; and a controller to supply power to perform the transferring process by detecting a leakage voltage and/or leakage current produced by the plurality of transferring units and measuring a resistance value of the attraction unit and any one of the plurality of transferring units with a smallest leakage voltage and/or leakage current value.

2. The image forming apparatus of claim 1, wherein the transferring process of the recording medium is performed by each of the plurality of transferring units corresponding to a plurality of ink colors.

3. The image forming apparatus of claim 1, wherein the controller obtains a resistance value of the transferring unit furthest from the attraction unit.

4. The image forming apparatus of claim 1, wherein the controller simultaneously obtains the resistance value of the one of the plurality of transferring units with the smallest leakage voltage and/or leakage current value and the resistance value of the attraction unit.

5. The image forming apparatus of claim 1, wherein the controller determines a magnitude of power generated by the transferring process corresponding to the recording medium according to the obtained resistance values of the attraction unit and the one of the plurality of transferring units with the smallest leakage voltage and/or leakage current value.

6. The image forming apparatus of claim 4, wherein the controller supplies the power at the determined magnitude to the plurality of transferring units.

7. A transferring method of an image forming apparatus, comprising:

attracting a recording medium to a conveyer belt in the image forming apparatus by an attraction unit;

detecting a leakage voltage and/or leakage current produced by a plurality of transferring units that transfer the recording medium;

obtaining a resistance value of the attraction unit;

measuring a resistance value of any one of the plurality of transferring units with a smallest leakage voltage and/or leakage current value; and supplying power to the plurality of transferring units to perform a transferring process of the recording medium based on the measured resistance value of the attraction unit and the one of the plurality of transferring units with the smallest leakage voltage and/or leakage current value.

8. The method of claim 7, further comprising:

obtaining a resistance value of the transferring unit furthest from the attraction unit.

9. The method of claim 7, further comprising:

determining a magnitude of the power generated by the transferring process corresponding to the recording medium according to the obtained resistance values; and supplying the power at the determined magnitude to the plurality of transferring units.

* * * * *